United States Patent [19]

Krämer et al.

[11] Patent Number: 4,957,084

[45] Date of Patent: Sep. 18, 1990

[54] FUEL INJECTION APPARATUS FOR INTERNAL COMBUSTION ENGINES

[75] Inventors: Manfred Krämer, Schwieberdingen; Erhard Sitter, Horb, both of Fed. Rep. of Germany

[73] Assignee: Robert Bosch GmbH, Stuttgart, Fed. Rep. of Germany

[21] Appl. No.: 272,887

[22] PCT Filed: Jun. 25, 1987

[86] PCT No.: PCT/DE87/00288

§ 371 Date: Oct. 13, 1988

§ 102(e) Date: Oct. 13, 1988

[87] PCT Pub. No.: WO88/00292

PCT Pub. Date: Jan. 14, 1988

[30] Foreign Application Priority Data

Jul. 5, 1986 [DE] Fed. Rep. of Germany ..... 3622626
Jun. 16, 1987 [DE] Fed. Rep. of Germany ..... 3720067

[51] Int. Cl.[5] ..... F02M 39/00
[52] U.S. Cl. ..... 123/447; 123/198 DB
[58] Field of Search ..... 123/447, 514, 510, 458

[56] References Cited

U.S. PATENT DOCUMENTS

| | | | |
|---|---|---|---|
| 2,986,881 | 6/1961 | Moore | 123/447 |
| 3,568,646 | 3/1971 | Wehde | 123/447 |
| 4,296,718 | 10/1981 | Baugh | 123/198 DB |
| 4,319,550 | 3/1982 | Ishii | 123/198 DB |
| 4,361,121 | 11/1982 | Clemens et al. | 123/198 |
| 4,381,750 | 5/1983 | Funada | 123/447 |
| 4,485,789 | 12/1984 | Walter | 123/447 |
| 4,530,329 | 7/1985 | Maisch | 123/458 |
| 4,565,170 | 1/1986 | Grieshaber et al. | 123/359 |
| 4,627,403 | 12/1986 | Matsumura | 123/458 |
| 4,811,710 | 3/1989 | Schmitt | 123/198 DB |

FOREIGN PATENT DOCUMENTS

| | | |
|---|---|---|
| 2145983 | 3/1973 | Fed. Rep. of Germany . |
| 2312860 | 3/1973 | Fed. Rep. of Germany . |

*Primary Examiner*—Carl Stuart Miller
*Attorney, Agent, or Firm*—Michael J. Striker

[57] ABSTRACT

A fuel injection apparatus for an internal combustion engine and comprising a fuel injection pump, a fuel delivery pump for communicating fuel from a fuel tank to the suction chamber of the fuel injection pump, and cut-off device for cutting off the fuel flow to the injection nozzles of the internal combustion engine in case of a disturbance, said cut-off device comprising a spring-loaded accumulator connected with the suction chamber of the fuel injection pump and an electromagnetically actuated control valve for effecting a rapid cut-off, said control valve communicating the outlet of the delivery pump with the fuel tank in case of a disturbance, whereby the accumulator provides for reduction of pressure in the suction chamber of the fuel injection pump so that fuel does not flow to the internal combustion engine.

12 Claims, 4 Drawing Sheets

FUEL INJECTION APPARATUS FOR INTERNAL COMBUSTION ENGINES

BACKGROUND OF THE INVENTION

The invention relates to a fuel injection apparatus for internal combustion engines, particularly for diesel engines.

In such fuel injection apparatus, the cut-off device serves to terminate the fuel injection as suddenly as possible during the occurrence of disturbances or errors. For this purpose, it is necessary not only to stop the delivery output of the delivery pump to the suction chamber of the fuel injection pump, but also to prevent the continued delivery of fuel from the suction chamber to the injection nozzles. The latter is no longer the case when the suction chamber pressure drops below 0.2 bar absolute, since the pump element of the fuel injection pump is then no longer sufficiently filled with fuel.

In a known fuel injection apparatus (DE-A-21 45 983), the cut-off device comprises a shut-off valve, which is constructed as a disk valve, and a suction pump which are combined to form a constructional unit. The suction pump comprises a plunger displaceable in a storage space and a pressure spring which acts upon the plunger. In normal operation, a mechanical locking device holds the plunger in a sliding out position when the pressure spring is tensioned, in which sliding out position the storage volume of the storage space is virtually zero. In this position, the disk valve is held by the plunger in the open position against the force of a valve closing spring via a valve tappet When the disk valve is open, the fuel delivered by the delivery pump arrives in the space defined by the plunger, in which the plunger pressure spring is arranged and flows out into the suction chamber When a cut-off is effected, the locking device is released The plunger is displaced by the plunger pressure spring and releases the storage space. A vacuum pressure accordingly arises in the line between the cut-off device and the suction chamber which prevents additional fuel from reaching the suction chamber of the injection pump. The plunger, sliding back in the storage space, also releases the disk valve, which moves into its closing position under the action of its valve closing spring. The delivery pump is blocked by the suction chamber and delivers back into the fuel tank via an overflow valve.

SUMMARY OF THE INVENTION

The object of the invention is to provide a fast-acting cut-off device with commercially available structural component parts, such as spring-loaded accumulators, simple hydraulic valves and magnetic valve, which fast-acting switch-off device is constructed in a simple manner in terms of design, and is inexpensive to manufacture. The object of the invention is achieved by providing a cut-off device which includes an inlet valve arranged upstream of the suction chamber and a spring-loaded accumulator whose storage chamber is connected with the output of the delivery pump and whose spring chamber is connected with the suction chamber of the fuel injection pump. An electromagnetically actuated control valve located in a by-pass line connecting the output of the delivery pump with the tank, blocks the by-pass line in normal operation and opens it upon actuation of the cut-off device. The suction chamber pressure is adjusted to a defined pressure, e.g. 1 bar overpressure, by an overflow valve. The delivery pressure, which exceeds the suction chamber pressure, in this case, e.g. 2 bar overpressure, loads the spring-loaded accumulator so that its spring chamber has the lowest possible volume. When cut-off is effected, the by-pass is opened, so that the overpressure generated by the delivery pressure in the storage chamber of the spring-loaded accumulator collapses. The spring-loaded accumulator is unloaded and the increasing spring chamber volume causes a reduction of pressure in the suction chamber to less than 0.2 bar absolute in this instance, so that the delivery of fuel to the injection nozzles is interrupted suddenly. The internal combustion engine receives no more fuel and immediately turns off.

By the electromagnetic control valve being a two-way valve, the greatest valve actuating force, in this instance, the closing force of the valve, is applied when the magnet armature is energized. Smaller forces are required for this than would be required if the greatest valve force had to be applied against the force of a closing spring in the moved out position of the magnet armature. Accordingly, the electromagnet of the control valve, particularly its winding space, can have smaller dimensions and, accordingly, the volume of the control valve can be kept small. Moreover, the control valve opens during unwanted interruption of current and accordingly halts the fuel injection.

Using a loaded inlet valve, which is arranged parallel to the storage chamber of the spring-loaded accumulator with respect to operation, the tensioning of the spring-loaded accumulator by the delivery pressure of the delivery pump at the beginning of delivery is ensured, on one hand, and blocking of the suction chamber of the injection pump relative to the delivery pump on the connection side is achieved, on the other hand.

By integrating the inlet valve in the spring-loaded acumulator and by connecting the spring chamber of the spring-loaded accumulator with the input of the suction chamber downstream of the inlet valve, simplification of the assembly of the fuel injection device is achieved.

By forming the inlet valve as a slide valve comprising a slide displaceable in a guide sleeve and connected with the diaphragm of the spring-loaded accumulator, and by forming special passages therein, the inlet valve need not be provided with an opening pressure which is as accurately defined as is the case in check valves which can likewise be employed as inlet valves. The inlet valve operates more reliably and also does not leak which frequently occurs in check valves, specifically because of overlapping during the shut-off.

By combining the overflow valve and the control valve in a single unit, an additional fuel line from the control valve to the fuel tank can be eliminated. Its function is taken over by the return line which is present in any case. The required reduction in pressure in the suction chamber is effected sufficiently quickly by connection of the spring chamber of the spring-loaded accumulator with the area of the suction chamber on the outlet side in fuel injection pumps in which means for defining or guiding the flow are provided in the area of the suction chamber on the inlet side and can delay the cut-off.

The invention both as to its construction so to its mode of operation, together with additional objects and advantages thereof, will be best understood from the following description of the preferred embodiments when with reference to the accompanying drawings.

DESCRIPTION OF THE PREFERRED EMBODIMENTS

Figure 1:
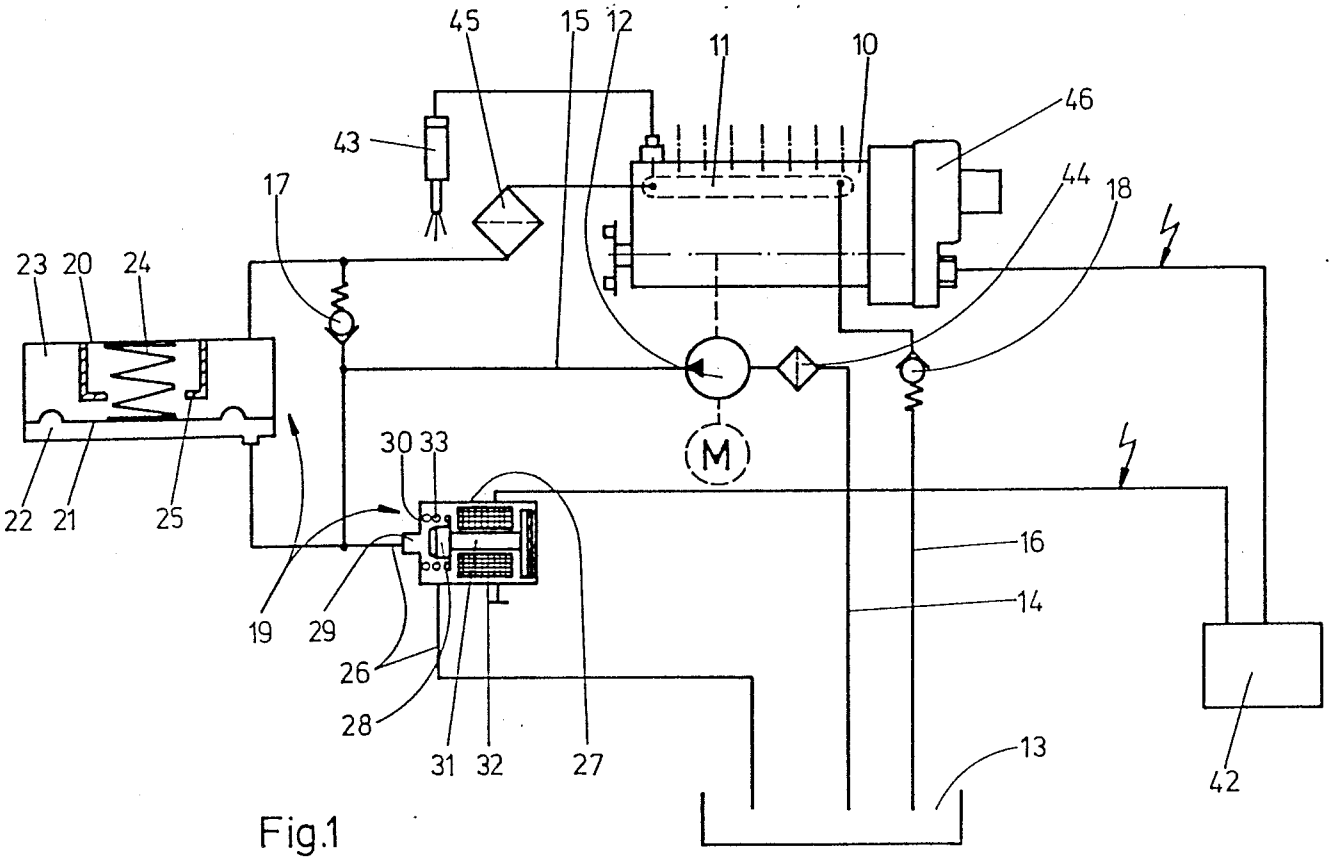
FIG. 1 shows a schematic block diagram of a first embodiment of a fuel injection apparatus according to the present invention.

The fuel injection apparatus for a diesel engine, known per se, shown in FIG. 1 as an example of an internal combustion engine, comprises a fuel injection pump 10 which is only indicated in a schematic manner. A fuel injection pump 10 sucks fuel out of a suction chamber 11 of the fuel injection pump 10 with a pump element, not shown, compresses the fuel an injection pressure, and delivers a fuel quantity under the injection pressure to injection nozzles associated with individual cylinders of a diesel engine. In FIG. 1, only a single injection nozzle 43 for an engine cylinder is shown for the sake of clarity.

The suction chamber 11 is filled with fuel from a fuel tank 13 by a fuel delivery pump 12. For this purpose, the delivery pump 12 is connected to a fuel tank 13 via a suction connection member 14 with a fuel filter 44, and to the input of the suction chamber 11 via a delivery line 15 with another fuel filter 45. The output of the suction chamber 11 is connected, in turn, with the fuel tank 13 via a return line 16. An inlet valve 17 is arranged in the delivery line 15 and an overflow valve 18 is arranged in the return line 16 with respectively defined opening pressures, 1 bar overpressure in this instance. The flow of the inlet valve 17 is effected in a direction from the delivery pump 12 to the suction chamber 11, whereas the flow of the overflow valve 18 is in a direction from the suction chamber 11 to the fuel tank 13. The two valves 17, 18, which are constructed here as simple check valves, ensure that a fuel delivery from the fuel tank 13 to the suction chamber 11 is only started at a defined delivery pressure of more than 2 bar absolute and that the overpressure in the suction chamber 11 is kept constant at 1 bar.

The two valves 17, 18 are part of a cut-off device 19 for cutting off fuel injection in cases of an emergency or a disturbance. The cut-off device 19 comprises, in addition, a spring-loaded accumulator 20 which is arranged between the delivery pump 12 and the suction chamber 11, that is, parallel to the inlet valve 17, and is divided into a storage chamber 22 and a spring chamber 23 by a diaphragm 21 in a known manner. A pressure spring 24, which is supported at the diaphragm 21, on one hand, and at the accumulator housing on the other hand, and a stop 25 for limiting the displacing movement of the diaphragm 21 are arranged in the spring chamber 23. The spring chamber 23 is connected with the inlet of the suction chamber 11 and with the outlet of the inlet valve 17, respectively, and the storage chamber 22 is connected with the outlet of the delivery pump 12 and with the inlet of the inlet valve 17, respectively. The pressure spring 24 is adjusted in such a way that, when the spring chamber 23 is without pressure, a pressure in the storage chamber 22 of 0.8 bar overpressure is sufficient for compressing the pressure spring 24 far enough so that the diaphragm 21 contacts the stop 25. In this position of the diaphragm 21, the spring-loaded accumulator 20 is loaded.

Another part of the cut-off device 19 is a control valve 27, which is arranged in a by-pass 26 which connects the output of the delivery pump 12 with the fuel tank 13. The control valve 27, which is constructed as a 2/2-way magnetic valve, blocks the by-pass 26 during normal operation, i.e. when the diesel engine is running, and opens it when the cut off is effected, i.e when the cut-off device 19 is actuated. As shown schematically in FIG. 1, the control valve 27 has a valve element 28 which cooperates with a valve seat 30 enclosing a valve inlet opening 29. The valve element 28 is securely connected with a magnet armature 31 of an electromagnet 32 and is held in the valve opening position by a valve opening spring 33 when the electromagnet 32 is in the unexcited state. The electromagnet 32 is switched by an electronic control device 42, which is electrically connected with an electric controlling mechanism 46 mounted on a fuel injection pump 10, and carries out other control functions which have no significance in this context.

The described cut-off device 19 operates in the following manner:

The electromagnet 32 of the control valve 27 is supplied with current when the diesel engine is started. The magnet armature 31 is energized and the valve element 28 is pressed on the valve seat 30, accompanied by the compression of the valve opening spring 33. The control valve 27 blocks the by-pass 26. Since there is still no pressure on the delivery side of the delivery pump 12, the magnetic force required for closing the valve is relatively small. When the fuel delivery is started by the delivery pump 12, a greater electromagnetic force must then be applied for keeping the control valve 27 closed when the magnet armature 31 is energized.

As soon as the delivery pressure exceeds the loading pressure of the spring-loaded accumulator 20, which pressure is adjusted to approximately 0.8 bar overpressure by the pressure spring 24, during the starting of the fuel delivery by means of the delivery pump 12, the spring-loaded accumulator 20 is loaded against the force of the pressure spring 24 by displacement of the diaphragm 21. As soon as the delivery pressure exceeds 1 bar overpressure, the inlet valve 17 opens and fuel flows into the suction chamber 11 of the fuel injection pump 10 via the delivery line 15. If the pressure in the suction chamber 11 exceeds 1 bar overpressure, the overflow valve 18 opens and excess fuel flows into the fuel tank 13 again via the return line 16. The pressure in the suction chamber 11 is accordingly held constant at 1 bar overpressure and loads the spring chamber 24 of the spring-loaded accumulator 20. The delivery pump 12 now delivers at an overpressure of 2 bar. Now, in a known manner, the fuel injection pump 10 provides the injection nozzles 43 of the cylinders of the diesel engine with fuel which is under an injection pressure.

A disturbance, occurring in the diesel engine which necessitates a cut-off of the diesel engine is detected by the electronic control device 42. The latter turns off the exciting voltage to the electromagnet 32 of the control valve 27. The valve opening spring 33 lifts the valve element 28 from the valve seat 30. The control valve 27 opens. The pressure on the output side of the delivery pump 12 is reduced via the opened control valve 27, so that the suction chamber flow is interrupted, and the inlet valve 17 and return-flow valve 18 close and block the suction chamber 11. The pressure spring 24 pushes back the diaphragm 21 because the pressure in the storage chamber 22 of the spring-loaded accumulator 20 is reduced. The volume of the spring chamber 23 increases and is filled with a fuel volume sucked out of the suction chamber 11. The pressure in the suction chamber 11 is accordingly reduced to less than 0.2 bar absolute. At this pressure in the suction chamber 11, the pump element of the injection pump 10 can no longer be sufficiently filled with fuel, so that fuel is no longer delivered to the injection nozzles. The diesel engine accordingly receives no more fuel and immediately turns off.

Figure 2:
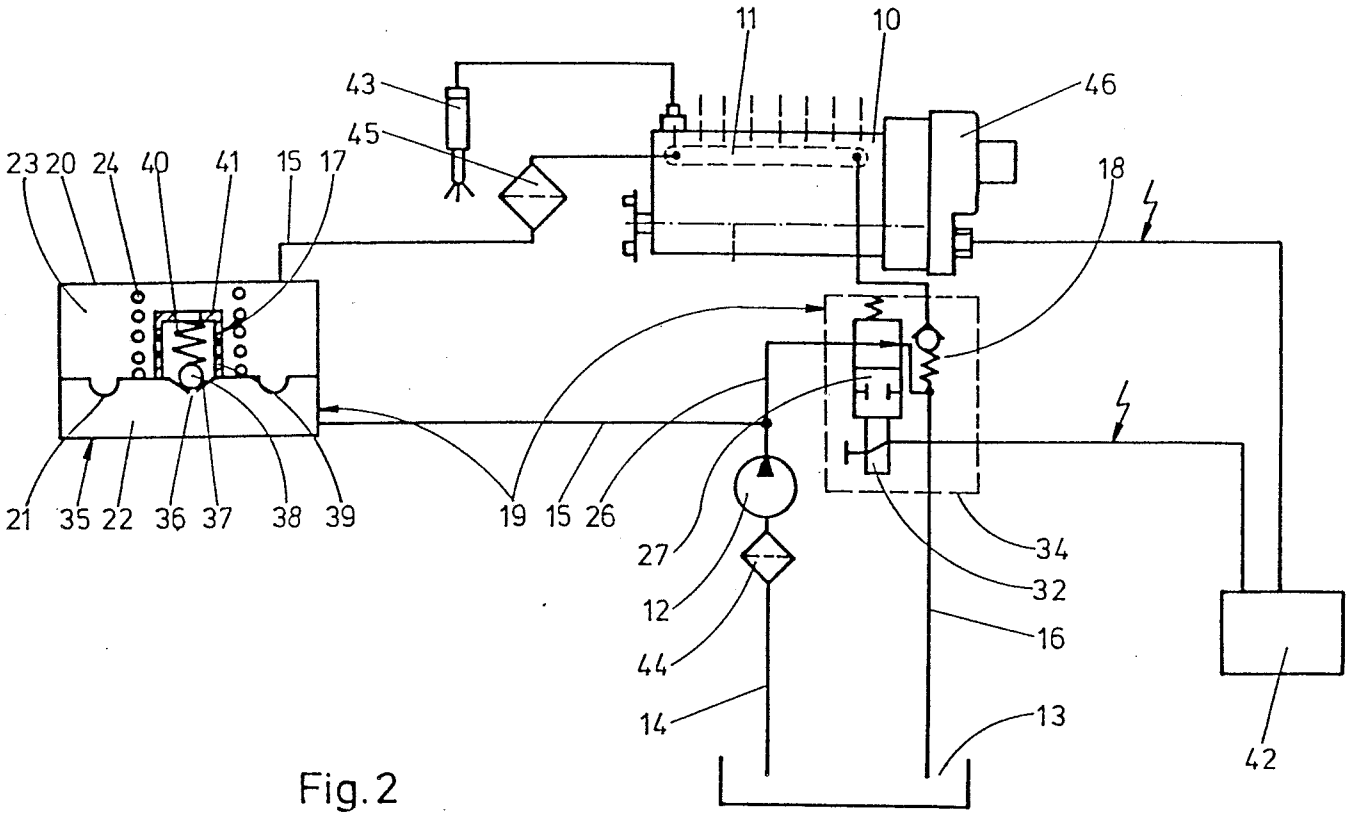
FIG. 2 shows a schematic block diagram of a second embodiment of a fuel injection apparatus according to the present invention.

The fuel injection apparatus shown in FIG. 2 differs from that in FIG. 1 only by the combination of various structural components of the cut-off device 19 to form constructional units. Identical structural component parts are, therefore, provided with the same numerals.

The overflow valve 18 located in the return line 16 is combined with the control valve 27 to form a constructional unit 34. The inlet of the control valve 27 is connected with the outlet of the delivery pump 12 as before, while the outlet of the control valve 27 is connected directly to the outlet of the overflow valve 18. The separate by-pass portion from the outlet of the control valve 27 to the fuel tank 13 can be eliminated. The fuel return from the outlet of the control valve 27 is effected via the return line 16.

The inlet valve 17 located in the delivery line 15 is integrated in the spring-loaded accumulator 20, thus, it is combined with the latter to form a second constructional unit 35. The diaphragm 21, which, as before, divides the spring-loaded accumulator 20 into pressure chamber 22 and spring chamber 23, comprises a flow opening 36 and a valve seat 37 enclosing the latter, the valve element 38 of the inlet valve 17 cooperates with the valve seat 37. The inlet valve 17 is fastened to the diaphragm 31 with a housing web 39, and the valve closing spring 40 is supported at the housing web 39, on one hand, and at the valve element 38, on the other hand. At the same time, the housing web 39 forms a stop 41 which corresponds to the stop 25 in FIG. 1 in terms of function and which comes to rest at the base of the spring chamber 23 against the force of the pressure spring 24 after a displacement distance of the diaphragm 21. In this instance, as well, the overflow valve 18 and the inlet valve 17 are constructed as a simple check valve.

The fuel injection device, according to FIG. 2, functions in an identical manner to that of FIG. 1 and, in so far as this applies, the above description will be referred to.

Figure 3:
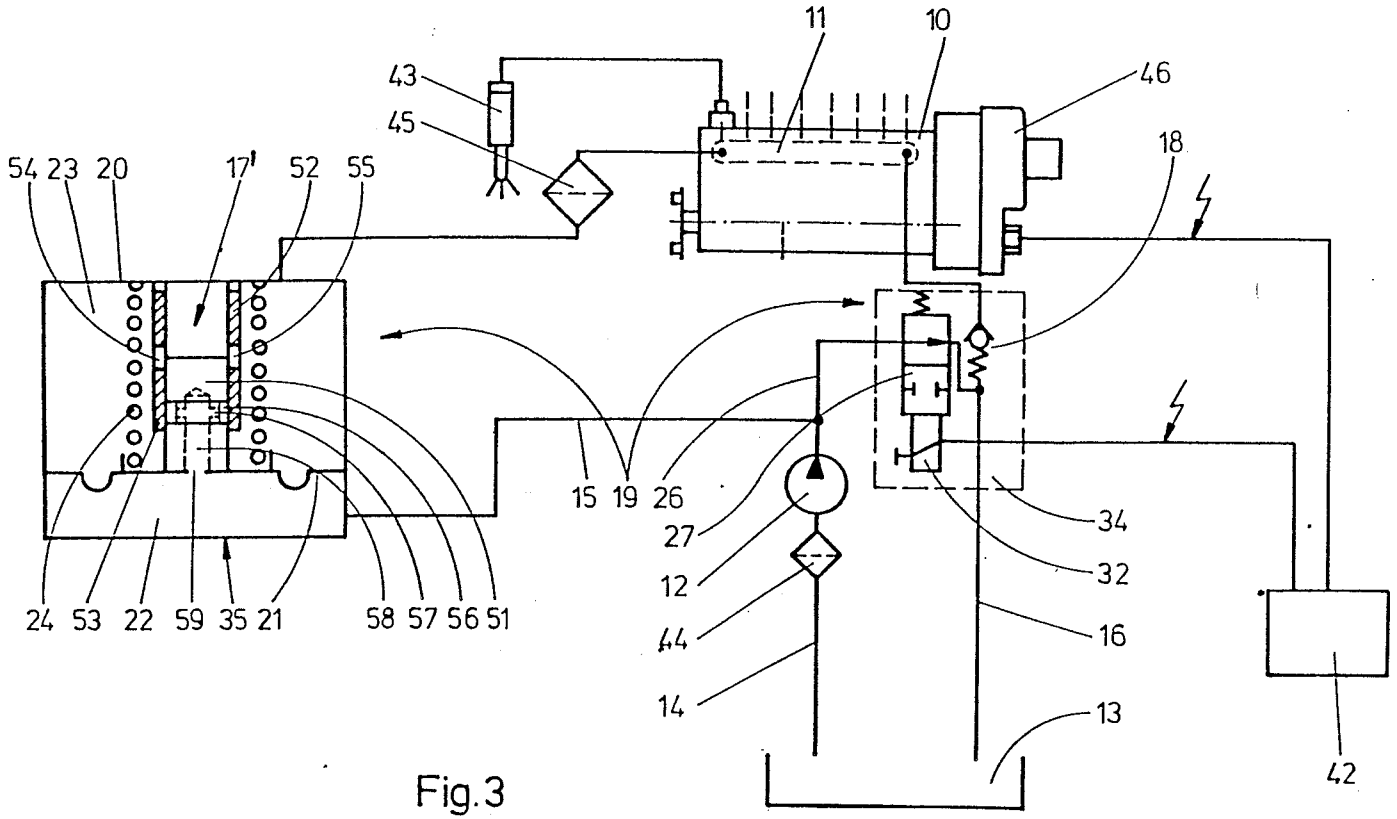
FIG. 3 shows a schematic block diagram of a third embodiment of a fuel injection apparatus according to the present invention.

The fuel injection device, shown schematically in FIG. 3, differs from that in FIG. 2 only through a different construction of the inlet valve 17' which is likewise integrated in the spring-loaded accumulator 20, that is, combined with the spring-loaded accumulator 20 to form a constructional unit 35. The same structural component parts are therefore provided with identical reference numerals. The inlet valve 17' , which acts as a one-way valve in this instance also, is constructed as a slide valve comprising a control slide 51 and a guide sleeve 52 which receives the control slide 51 in an axially displaceable manner. The inlet valve 17' is arranged in the spring chamber 23 of the spring-loaded accumulator 20, wherein the guide sleeve 52 is fastened at the base of the spring chamber 23 and the control slide 51 is fastened at the diaphragm 21. The pressure spring 24, in turn, is supported at the base of the spring chamber 23 and at the diaphragm 21 in the same manner. The front side of the guide sleeve 52 facing the diaphragm 21 forms a stop 53 which is comparable to the stop 41 in FIG. 2 and the stop 25 in FIG. 1, respectively. The guide sleeve 52 comprises two diametrically opposite radial bore holes 54, 55 which cooperate with an annular control groove 56 at the circumference of the control slide 51. The control groove 56 is connected with an axial duct 58 via a transverse bore hole 57, the axial duct 58 being constructed as a pocket bore hole. The axial duct 58 opens out at the front side of the control slide 51 fastened at the diaphragm 21 , specifically so as to be coaxial with a flow opening 59 in the diaphragm 21. The control groove 56 at the control slide 51 and the radial bores 54, 55 in the guide sleeve 52 are spaced from one another in such a way that they first enter into connection with one another when the diaphragm 21 contacts the stop 53, and fuel can then flow into the spring chamber 23 from the storage space 22 via the axial duct 58, the transverse bore 57, the control groove 56 and the radial bores 54, 55. In all other positions of the diaphragm 21 and, accordingly, of the control slide 51, the control groove 56 is covered by the inner wall of the guide sleeve 52 so as to be watertight.

The manner of operation of this fuel injection device agrees to a great extent with the two fuel injection devices described above with the following difference: After the starting of the diesel engine and the blocking of the by-pass 26 by the control valve 27, the fuel flowing into the storage chamber 22 displaces the diaphragm 21 against the force of the return spring 24 until the stop 53 at the guide sleeve 52. In this position, the control groove 56 lies in the area of the radial bores 54, 55 and the flow is provided from the delivery pump 12 to the suction chamber 11. The pressure prevailing in the suction chamber 11 is exclusively determined by the overflow valve 18 and can be adjusted as desired.

When the electronic control device 42 detects the disturbance and switches off the magnetic excitation of the switching valve 27, the storage chamber 22 is connected to the released by-pass 26. The pressure in the storage chamber 22 is accordingly abruptly reduced. The pressure spring 24 pushes back the diaphragm 21 and, accordingly, the control slide 51 fastened at the diaphragm 21, so that the control groove 56 is again closed by the guide sleeve 52 and the spring chamber 23 is again hermetically separated from the storage chamber 22. In the same way, the increasing spring chamber volume provides the necessary pressure reduction in the suction chamber 11 to the absolute pressure of 0.2 bar.

Figure 4:
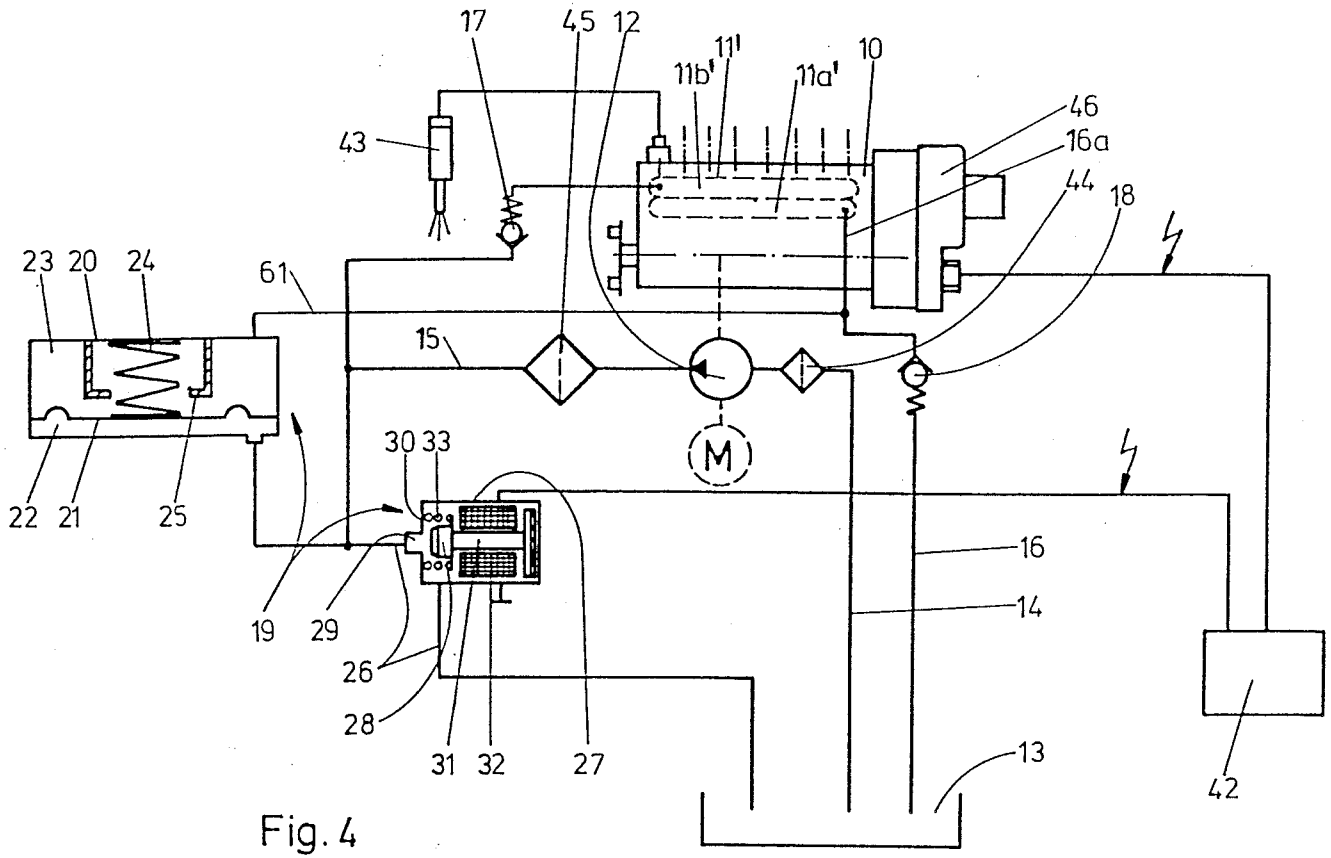
FIG. 4 shows a schematic block diagram of a fourth embodiment of a fuel injection apparatus according to the present invention.

The fuel injection apparatus shown in FIG. 4 differs from that in FIG. 1 substantially only through a differently formed connection of the spring chamber 23 of the spring-loaded accumulator 20 with the suction chamber 11'. In addition, the respective positions in which the inlet valve 17 and the fuel filter 45 are mounted have been changed. The same structural component parts are therefore also provided with the same reference numerals in this case, the suction chamber, which is constructed differently, being provided with the reference numeral 11'.

Both the storage chamber 22 and the input of the suction chamber 11' are connected to the delivery line 15 of the delivery pump 12, as is the by-pass 26 provided with the switching valve 27. However, in FIG. 4, the spring chamber 23 of the spring-loaded accumulator 20 has no connection to the delivery line 15, rather, it is connected, with the area 11*a'* of the suction chamber 11' on the outlet side via a suction line 61, wherein the suction line 61 is connected to a portion 16*a* of the return line 16 located upstream of the overflow valve 18.

Of course, the overflow valve 18 and the spring chamber 23 are to be mounted as close as possible to the suction chamber 11, in order to keep the space which is to be partially evacuated for cut-off as small as possible, which is advantageous for a fast-acting cut-off. For this reason, the inlet valve 17 has also been shown in the drawing so as to be closer to an area 11*b*, of the suction chamber 11' on the inflow side. The fuel filter 45 is connected directly behind the delivery pump 12, as is customary in injection systems, so that its fuel volume cannot delay the cut-off. Of course, the above-described mounting steps for reducing the space or volume, respectively, to be evacuated are also advantageous in the previously described embodiment examples, according to FIGS. 1 to 3, and can therefore also be applied to them.

The division of the suction chamber 11' into an area 11*a'* on the outlet side and an area 11*b'* on the inlet side, which is indicated by means of a dashed line, is supposed to indicate that this is a fuel injection pump whose suction chamber 11' is divided for a directed flow from the inlet side to the outlet side and comprises throttling points which obstruct the flow on the inlet side. Such a fuel injection pump is known e.g. from FIG. 6 of the DE-A-35 09 536 and is, therefore, also not the subject matter of the present invention.

The manner of operation of the previously described fourth embodiment corresponds substantially to that of the first embodiment described in reference to FIG. 1. Only the spring chamber 23 of the spring-loaded accumulator 20, which spring chamber increases during the cut-off is connected to the area 11*a'* of the suction chamber 11' on the outlet side upstream of the overflow valve 18 by means of the suction line 61 and, in this instance, the portion 16*a* of the return line 16. Since this connection is effected between the inlet valve 17 and the overflow valve 18 in this embodiment, as well, the suction chamber 11' is put under vacuum pressure in this instance also, as in the previously described examples, when the control valve 27 is open and the volume of the spring chamber 23 is increasing, so that the injection pump 10 can no longer deliver, and the respective internal combustion engine "dies", i.e. stops.

The cut-off device realized in each of the embodiment leads to a very rapid cut-off if the fuel delivery pump 12 is electrically driven and the delivery pump also stops when the cut-off is effected. However, the described embodiments are also can be used in an advantageous manner when there is a mechanically driven fuel delivery pump, e.g. a fuel delivery pump driven from the camshaft of the injection pump 10, since the delivery line is closed by the control valve 27, the delivery into the suction chamber 11, 11' is accordingly stopped, and the increasing volume of the spring chamber 23 provides for the vacuum pressure required in the suction chamber for cut-off, so that a rapid cut-off is effected in this instance, as well.

Of course, the invention also comprises combinations of the device described in the four embodiments. Thus, in a special case, the spring chamber 23 can be connected both to the input and to the output of the suction chamber 11, 11' if this is necessary with corresponding large pumps. A central connection to the suction chamber is also conceivable if a corresponding connection is provided, and this step leads to a quicker cut-off.

While the invention has been illustrated and described with reference to specific embodiments of a fuel injection apparatus, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A fuel injection apparatus for internal combustion engines, particularly diesel internal combustion engines having injection nozzles and a fuel injection pump with a suction chamber for communicating fuel from the suction chamber to the injection nozzles, said fuel injection apparatus comprising:

a fuel delivery pump for communicating fuel from a fuel tank to the suction chamber of the fuel injection pump;

a return line for communicating the suction chamber of the fuel injection pump with the fuel tank;

an overflow valve located in said return line for limiting pressure in the suction chamber; and a cut-off device located downstream of said delivery pump and upstream of the fuel injection pump, said delivery pump having an outlet, said cut-off device comprising an inlet valve located upstream of the suction chamber of the fuel injection pump and having an open position in which it communicates said outlet of said delivery pump with the suction chamber, a spring-loaded accumulator including a storage chamber communicating with said outlet of said delivery pump, a spring chamber communicating with the suction chamber of the injection pump, a spring located in said spring chamber for loading said accumulator, a fuel bypass line communicating said outlet of said delivery pump with the fuel tank, and a control valve located in said bypass line for communicating said outlet of said delivery pump with the fuel tank upon actuation of said cut-off device.

2. A fuel injection apparatus according to claim 1, wherein said control valve is an electromagnetically actuated valve.

3. A fuel injection apparatus according to claim 2, wherein said control valve is a two-way magnetic valve opening in an unexcited state thereof.

4. A fuel injection apparatus according to claim 2, wherein said spring-loaded accumulator comprises a diaphragm loaded by said spring, said diaphragm separating said storage chamber from said spring chamber in a water-tight manner.

5. A fuel injection apparatus according to claim 2, wherein said inlet valve has an opening pressure which is at least equal to a loading pressure of said spring loaded accumulator.

6. A fuel injection apparatus according to claim 5, wherein said spring-loaded accumulator is connected with the inlet of the suction chamber of the fuel injection pump downstream of said inlet valve, said spring-loaded accumulator having an inlet and an outlet, said inlet valve being connected to said inlet and outlet of said spring-loaded accumulator so as to be parallel to said spring-loaded accumulator.

7. A fuel injection apparatus according to claim 5, wherein said spring chamber of said spring-loaded accumulator is connected with the inlet of the suction chamber of the fuel injection pump downstream of said inlet valve, said inlet valve being formed integral with said spring-loaded accumulator.

8. A fuel injection apparatus according to claim 7, wherein said diaphragm has a flow opening, said inlet valve being formed as a check valve and being located in said spring chamber, said inlet valve comprising a valve seat located in said opening in said diaphragm and a valve member cooperating with said valve seat for controlling flow of fuel through said openings.

9. A fuel injection apparatus according to claim 7, wherein said diaphragm has an opening for communicating said spring chamber with said storage chamber, said inlet valve comprising a control slide connected with said diaphragm and movable to permit flow of fuel through said opening in said diaphragm after said spring-loaded accumulator has been loaded.

10. A fuel injection apparatus according to claim 9, wherein said diaphragm includes a duct defining said opening in said diaphragm and having radial bores, said inlet valve comprising a guide sleeve located in said spring chamber and having at least one radial opening, said control slide being displaceable in said guide sleeve and having an annular control groove communicating with said storage chamber via said radial bores in said duct in said opening in said diaphragm, said radial opening in said sleeve and said control groove in said control slide being so arranged relative to one another that they communicate after a predetermined displacemente of said control slide relative to said guide sleeve.

11. A fuel injection apparatus according to claim 1, wherein said overflow valve has an outlet, said overflow valve and said switching valve being formed integrally with each other to form a constructional unit, said control valve having an outlet connected with said outlet of said overflow valve.

12. A fuel injection apparatus according to claim 1, wherein said suction chamber has an area adjacent the outlet side thereof upstream of said overflow valve, said spring-loaded chamber being connected with said area.

* * * * *